US006378290B1

(12) United States Patent
Killinger et al.

(10) Patent No.: US 6,378,290 B1
(45) Date of Patent: Apr. 30, 2002

(54) HIGH-FREQUENCY ION SOURCE

(75) Inventors: Rainer Killinger, Recklinghausen; Hans Mueller; Helmut Bassner, both of Munich; Ralph Kukies, Ottobrunn, all of (DE)

(73) Assignee: Astrium GmbH, Munich (DE)

( * ) Notice: Subject to any disclaimer, the term of this patent is extended or adjusted under 35 U.S.C. 154(b) by 0 days.

(21) Appl. No.: 09/685,793

(22) Filed: Oct. 10, 2000

(30) Foreign Application Priority Data

Oct. 7, 1999 (DE) ..... 199 48 229

(51) Int. Cl.[7] ..... H05H 1/00
(52) U.S. Cl. ..... 60/202; 60/204
(58) Field of Search ..... 60/202, 203.1, 60/204

(56) References Cited

U.S. PATENT DOCUMENTS

| | | | | | |
|---|---|---|---|---|---|
| 3,173,246 | A | * | 3/1965 | Norgren | 60/202 |
| 3,173,248 | A | * | 3/1965 | Curtis et al. | 60/202 |
| 3,174,278 | A | * | 3/1965 | Barger et al. | 60/202 |
| 3,191,092 | A | * | 6/1965 | Baker et al. | 60/202 |
| 3,309,873 | A | * | 3/1967 | Cann | 60/202 |
| 3,318,094 | A | * | 5/1967 | Koller | 60/202 |
| 3,343,022 | A | * | 9/1967 | Eckert | 60/202 |
| 4,191,888 | A | * | 3/1980 | Meadows | 60/202 |
| 5,170,623 | A | | 12/1992 | Dailey et al. | |
| 5,241,244 | A | * | 8/1993 | Cirri | 315/111.41 |
| 5,300,861 | A | * | 4/1994 | Helgesen et al. | 60/202 |
| 5,414,238 | A | * | 5/1995 | Steigerwald et al. | 60/203.1 |
| 6,216,445 | B1 | * | 4/2001 | Byers et al. | 60/202 |

FOREIGN PATENT DOCUMENTS

| | | |
|---|---|---|
| DE | 2633778 | 2/1978 |
| EP | 0537123 | 4/1993 |
| EP | 0560742 | 9/1993 |
| JP | 2-230971 | 9/1990 |

* cited by examiner

*Primary Examiner*—Ted Kim
(74) *Attorney, Agent, or Firm*—W. F. Fasse; W. G. Fasse

(57) ABSTRACT

A high-frequency ion source, in particular a high-frequency ion engine, includes a discharge chamber or container (2), a source (9) providing a gas to be ionized, a gas inlet (10) discharging the gas from the source into the discharge container (2) to be ionized therein, a high-frequency coil (3) surrounding the discharge container (2), and a high-frequency generator (4) connected to the high-frequency coil (3), for generating a high-frequency electromagnetic alternating field that ionizes the gas present in the discharge container (2). Furthermore, an acceleration grid (11) connected to an acceleration voltage source (12) is arranged at the open end of the discharge container (2) so as to accelerate the ions generated in the discharge container (2) in the form of an ion beam emanating from the discharge container (2). The shape of the discharge container (2) in longitudinal section is tapered to become smaller toward the closed end (6) opposite the open end (5) of the container. Also, the high-frequency coil (3) at least partly surrounds the discharge container (2) in the tapered section.

24 Claims, 2 Drawing Sheets

HIGH-FREQUENCY ION SOURCE

This application is based on and claims the priority under 35 U.S.C. §119 of German Patent Application 199 48 229.2, filed on Oct. 7, 1999, the entire disclosure of which is incorporated herein by reference.

FIELD OF THE INVENTION

The invention relates to a high-frequency ion source including a discharge chamber into which a gas is supplied, and a high-frequency coil surrounding the chamber for ionizing the gas.

The invention relates to a high-frequency ion source and particularly an ionic propulsion engine for a spacecraft, including a discharge chamber into which a gas is supplied, and a high-frequency coil surrounding the chamber for ionizing the gas.

BACKGROUND INFORMATION

High-frequency ion sources are used in space technology as engines in space vehicles. The assignee of the present application has developed a high-frequency ion engine comprising a discharge chamber (also called a discharge container herein) at one end, with a gas inlet for supplying into the discharge container a gas to be ionized in the discharge container, and a source for the gas to be ionized, said source being connected to the gas inlet. The engine further comprises a high-frequency coil surrounding the discharge container, a high-frequency generator connected to the high-frequency coil, for generating a high-frequency electromagnetic alternating field which ionizes the gas present in the discharge container, and an acceleration grid arranged at the open end of the discharge container and connected to an acceleration voltage source. In this high-frequency ion engine, which is known as an RIT (radio-frequency ion thruster), in the discharge container, which is made of an electrically non-conductive material, a high-frequency field is generated by means of the high-frequency coil surrounding the discharge container. This high-frequency field ionizes a propellant present in the discharge container, preferably an inert gas such as xenon. To ignite the discharge, free electrons supplied by an external electron source are accelerated through the high-frequency field and collide with neutral propellant particles, i.e. inert gas atoms. At every collision an electron is ejected from the neutral atom, and the atom is positively ionized. The electrons which are released are again accelerated and collide with other neutral atoms, thus starting a process of ionization, and generating a plasma comprising ions, electrons and neutral propellant. The fraction of ions in the plasma is determined by the output provided by the high-frequency field. When the discharge has ignited, it sustains itself; there is no need for any external supply of electrons. Thrust is generated by means of a voltage applied to the acceleration grid by the acceleration voltage source. Ions present near the acceleration grid are accelerated by the electrical field generated by means of the acceleration voltage, with a focused ion beam being formed. Generally, a neutralizer is used which supplies electrons to the ion beam during thrust operation, so as to prevent negative charging of the engine.

Previously, in such a high-frequency ion engine, a discharge chamber or container of cylindrical shape was used. In such a container the gas inlet for the gas to be ionized is located in a plane or slightly conical end surface (called the "closed end" surface herein) of the cylinder, which closed end surface is opposite the open end of the discharge container. It should be understood that the term "closed end" is simply a convenient shorthand name for the end of the container opposite the "open end", and it does not require this end to be completely "closed". To the contrary, for example, the gas inlet opening may be provided in the "closed end". The above-mentioned acceleration grid for accelerating the ion beam is provided at the opposite open end surface. The acceleration grid comprises two to three thin plates made of an electrically conductive material, with a plurality of holes provided therein, with said holes being arranged so as to form extraction channels which focus and accelerate the ions. The plates forming the acceleration grid can be plane or slightly curved in the extraction region. In the known configuration, the high-frequency coil surrounds the cylindrical part of the discharge container.

A high-frequency ion engine as described above is for example known from published European Patent Application EP 0,560,742. Analogous arrangements are described in published European Patent Application EP 0,537,123, German Patent Laying-Out Document DE 26 33 778 and Japanese Patent Laying-Open Document JP 2-230971. By contrast, U.S. Pat. No. 5,170,623 discloses a hybrid drive system formed by a combination of a combustion engine and an electromagnetic engine. The combustion gases of a usual rocket combustion engine are additionally accelerated by means of an electromagnetic coil in the region of the expansion nozzle of the rocket engine.

SUMMARY OF THE INVENTION

It is an object of the invention to create an improved high-frequency ion source such as an ion engine, and a method of operating the same, with an increased structural strength, reduced weight, improved ionization, increased efficiency and increased thrust to mass ratio. The invention further aims to avoid or overcome the disadvantages of the prior art, and to achieve additional advantages, as apparent from the present specification.

The above objects have been achieved according to the invention in a high-frequency ion source comprising a discharge chamber or container open at one end, with a gas inlet for discharging into the discharge container a gas to be ionized in the discharge container, and a source for the gas to be ionized, said source being connected to the gas inlet. The ion source further comprises a high-frequency coil surrounding the discharge container, a high-frequency generator connected to the high-frequency coil, for generating a high-frequency electromagnetic alternating field which ionizes the gas present in the discharge container, and an acceleration grid arranged at the open end of the discharge container and connected to an acceleration voltage source. The invention provides for the discharge container to have a tapered shape in longitudinal section, which shape tapers toward the closed end opposite the open end. Further according to the invention, the high-frequency coils of the discharge container at least partly surround the discharge container in the tapered section.

The inventive configuration of the high-frequency ion source provides a number of significant advantages. One advantage is the increased mechanical strength of the discharge container at lower weight. There is a further advantage in that an increased field strength is attained in the region of the gas inlet, due to the small diameter of the coil in this region, leading to improved ionization of the propellant and improved mass efficiency. A further advantage is provided by a more even distribution of the plasma density across the container radius in the region of the acceleration grid and thus increased extractable ion streams and improved thrust. A further advantage is provided by a reduction in wall losses, i.e. of ions which neutralize on the wall without being accelerated, as a result of a reduced wall surface in relation to the volume of the discharge container. It is also advantageous that with the same surface of the interior wall and the same diameter in the region of the acceleration grid, the discharge container can be greater in length, so that the path length between the gas inlet and the acceleration grid is longer and thus the probability of ionization of the propellant atoms is improved.

Finally, in the case of a particular embodiment according to the invention, in contrast to a cylindrical shape of the discharge container, with the same length of the discharge container, the high-frequency coil will experience lesser rheostatic losses because the average diameter is smaller and thus the coil wire is shorter.

An advantageous embodiment of the invention provides for the discharge container to be of frusto-conical shape in longitudinal section.

Another advantageous embodiment of the invention provides for the discharge container to be of frusto-conical cylindrical shape in longitudinal section, with a cylindrical part facing the open end, and a frusto-conical part facing the closed end opposite the open end.

Another advantageous embodiment of the invention provides for the discharge container to be conical frustum-shaped in longitudinal section.

A further advantageous embodiment of the invention provides for the discharge container to be nozzle-shaped in longitudinal section, whereby the nozzle-shape tapers with an increasing curvature.

An advantageous embodiment of the invention provides for the discharge container comprising a plane, slightly curved and conical end surface at the closed end opposite the open end.

Preferably, the gas inlet in the closed end surface opposite the open end, leads into the discharge container.

An advantageous embodiment of the invention provides for the high-frequency coil to be configured as a single-layer coil.

Preferably the discharge container comprises an electrically non-conductive solid material of little high-frequency loss in the range between 0.5 MHz and 100 MHz, in particular made of quartz, aluminum oxide, other ceramic material, Vespel, boron nitride or Macor.

Preferably the discharge container is surrounded by a housing comprising a conductive material, in particular metal. Preferably the shape of the housing matches that of the discharge container. Advantageously, the housing comprises a cylindrical or conical/cylindrical shape. An advantageous embodiment provides for the housing to surround the discharge container at a distance of 1 to 4 cm.

Advantageously, the high-frequency coil is excited by a resonance frequency of 0.5 MHz to 5 MHz. Preferably the high-frequency generator comprises a phase-locked loop (PLL) control circuit.

Furthermore, the invention provides a method for operating a high-frequency ion source of the type described above, in which the high-frequency coil is operated in resonance, both before ignition of the discharge in the discharge container and in idling operation after ignition of the charge, but without applying an acceleration voltage to the acceleration grid, as well as during thrust operation with acceleration of the ions through the acceleration grid.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
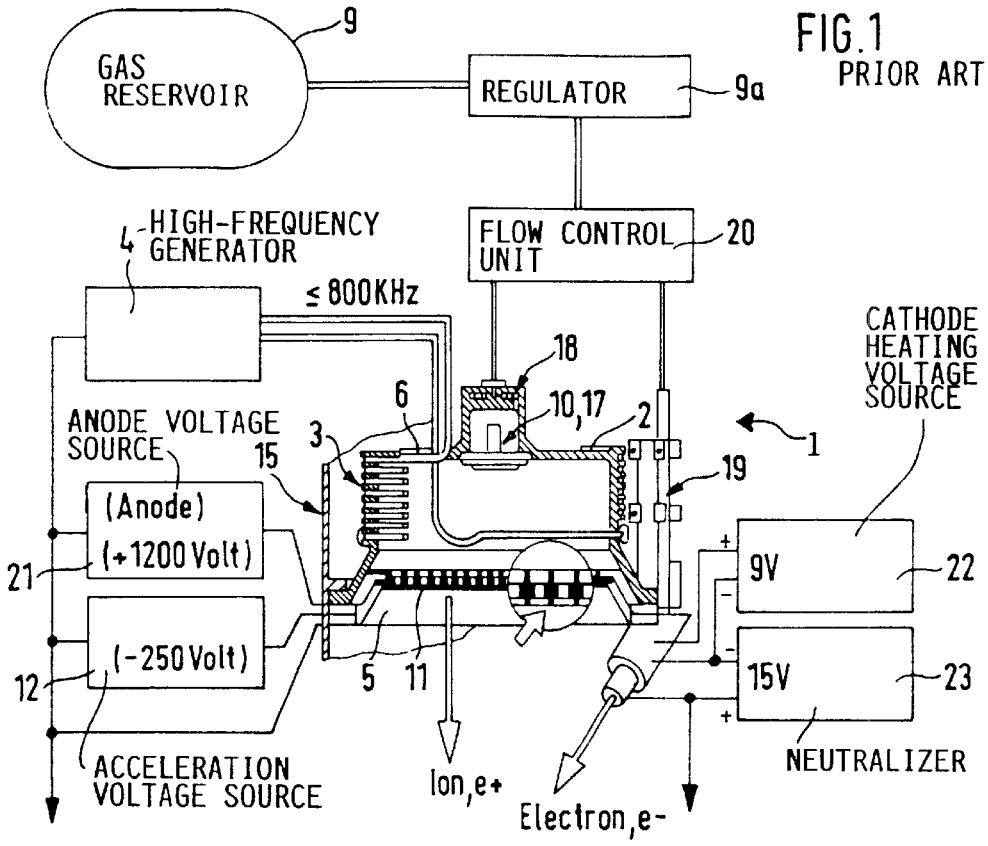
FIG.1 PRIOR ART
FIG. 1 is a schematic block diagram of a conventional high-frequency ion source embodied as an ion engine, for explaining the operational functions of such a high-frequency ion source.

In connection with FIG. 1, first the basic design and function of a high-frequency ion source in the manner of an ion engine is to be described. The high-frequency ion source designated overall by reference number 1 comprises a discharge chamber or container 2 which in FIG. 1 is shown in its conventional cylindrical shape. The discharge container 2 has an open end 5 and a closed end 6 opposite said open end. The discharge container 2 is surrounded by a high-frequency coil 3 which is connected to a high-frequendy generator 4. The high-frequency generator 4 supplies a high frequency, ranging from approx. 0.5 MHz to 5 MHz, typically ≦800 kHz and comprises a phase-locked loop (PLL) control circuit. The discharge container 2 comprises an electrically non-conductive material with little high-frequency loss in a wide frequency range, approx. 0.5 MHz to 100 MHz. The material can be quartz, aluminum oxide, other ceramic material, Vespel, boron nitride or Macor or another suitable material. Together with a capacitor which can be arranged within the high-frequency generator 4 or outside it, the high-frequency coil 3 forms a series or parallel resonance circuit. The high-frequency coil 3 can be operated either with one side connected to ground or insulated from ground. The high-frequency coil 3 and the high-frequency generator 4 are used to generate a high-frequency electromagnetic alternating field which ionizes a gas present in the discharge container.

An acceleration grid 11 is arranged at the open end 5 of the discharge container 2, and is connected to an acceleration voltage source 12. The acceleration voltage source 12 supplies an acceleration voltage of e.g. −250 V. The acceleration grid 11 typically comprises two or three thin plates of an electrically conductive material, in particular a metal, said plates comprising a plural number of holes therein. These holes are arranged such that in the installed state they form extraction channels in which the ions generated in the discharge container 2 are accelerated and focused. The plates constituting the acceleration grid 11 can be plane or slightly curved in the extraction region. Furthermore, an anode voltage source 21 is provided which can supply an anode voltage of for example +1200 V.

The gas to be ionized in the discharge container 2 is fed to the discharge container 2 via a gas inlet 10 at the closed end 6 opposite the open end 5 of the discharge container 2. The gas, which is preferably an inert gas such as xenon, is stored in a gas reservoir 9 and supplied to the gas inlet 10 via a control or regulating unit 9*a* and a flow control unit 20. A flow limiter 17 for limiting the gas through-flow to a specified value, is located in the gas inlet 10. Supply of the gas to be ionized from the flow control unit 20 to the gas inlet 10 is via an insulator 18.

The gas that is supplied to the discharge container 2, as the propellant for the ion engine, is ionized in a process in which first of all free electrons are accelerated in the discharge container 2 by the high-frequency field generated by the high-frequency coil 3 and collide with neutral atoms of the gas. During the collision, electrons are ejected from the neutral atoms, which thus become positively charged and thereby generate ions. The electrons released in this process are in turn accelerated, and then they collide with further neutral gas atoms. This creates a process of ionization in which a plasma comprising ions, electrons and neutral gas is produced. The fraction or proportion of ions in the plasma is determined by the power provided by the high-frequency generator 4 as a high-frequency output. As soon as the discharge and generation of plasma in the discharge container 2 has ignited, said discharge is self-sustaining, and no further supply of electrons from an external source is required. The free electrons for igniting the discharge at the beginning of the ionization process are supplied by an external electron source. In the ion engine shown, the neutralizer 19, which is provided at the rear of the acceleration grid 11, is used for this purpose. The neutralizer 19 is used to supply electrons into the ion beam during the thrust operation of the ion engine, so as to prevent negative charging of the engine. For this purpose,the neutralizer 19 is connected to a neutralizer voltage source 23 as well as with a cathode heating voltage source 22 which is used to heat a cathode which supplies the electrons. The thrust of the ion engine is generated by an electrostatic acceleration field which is caused at the acceleration grid 11 by the voltages supplied by the acceleration voltage source 12 and by the anode voltage source 21. In this electrostatic acceleration field, ions are accelerated which are present in the discharge container 2 in the vicinity of the acceleration grid 11. These ions are focused to an ion beam in the extraction channels of the plates forming the acceleration grid 11. The accelerated ions generate the thrust according to the principle of propulsion by reaction.

The discharge container 2 is surrounded by a housing 15.

Figure 2:
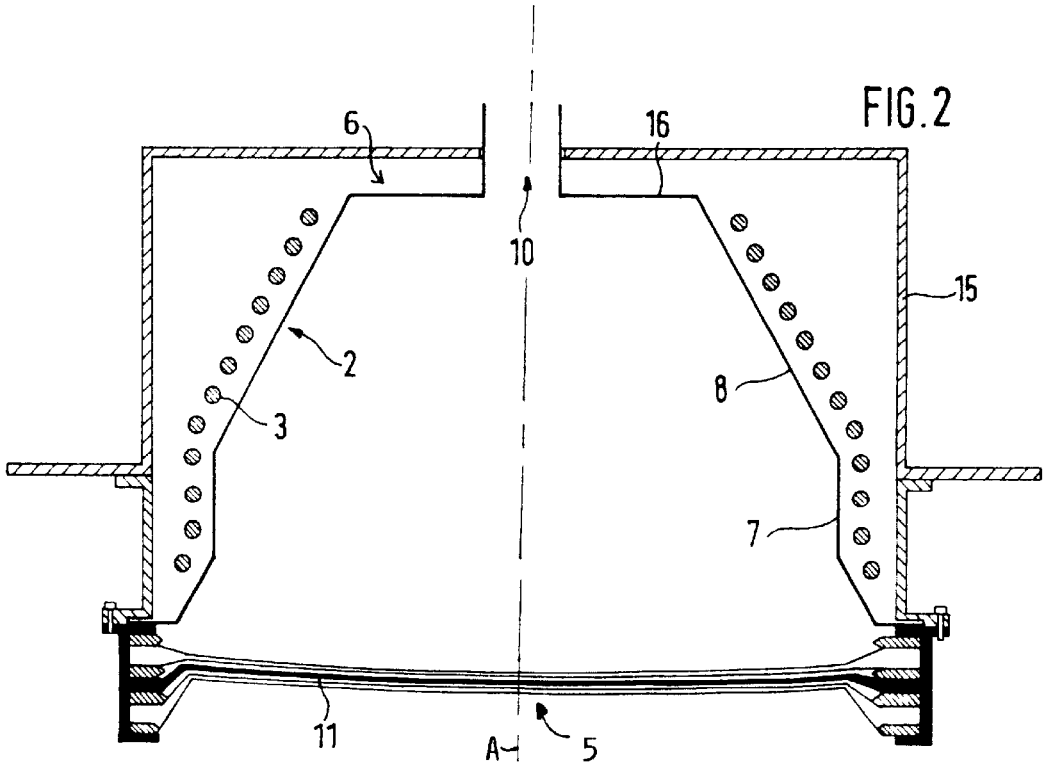
FIG. 2 is an enlarged cross-sectional representation of a discharge container of a high-frequency ion source according to one embodiment of the invention.

According to the present invention, the general shape of the discharge container 2 in longitudinal section has a diminishing taper toward the closed end 6 located opposite the open end 5. The high-frequency coil 3 is arranged such that it at least partly surrounds the discharge container 2 in the tapering region. In the embodiment shown in FIG. 2, the shape of the discharge container 2 in longitudinal section is conical/cylindrical about a central axis A of the container 2, with a cylindrical part 7 toward the open end 5 and a conical part 8 toward the closed end 6 opposite the open end 5. At the closed end 6 opposite the open end 5, the discharge container 2 in the embodiment shown in FIG. 2 comprises a plane end surface 16, in the center of which the gas inlet 10 is arranged.

The high-frequency coil 3 surrounds both the cylindrical part 7 and the conical part 8 of the discharge container 2. The high-frequency coil is a single-layer coil as shown in cross-section in FIG. 2, i.e. it is made up of a single layer of windings.

The discharge container 2 is made of an electrically non-conductive material with little high-frequency loss in the range of 0.5 MHz to 100 MHz. In particular the container 2 may be made of quartz, aluminum oxide, other ceramic material, Vespel, boron nitride or Macor.

Figure 3:
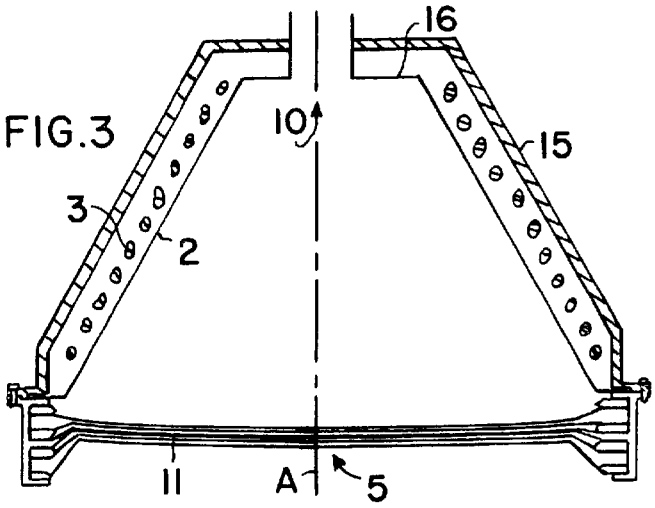
FIG. 3 is a sectional view similar to FIG. 2, but with an alternative shape of the discharge container and the housing of the ion source.
Figure 4:
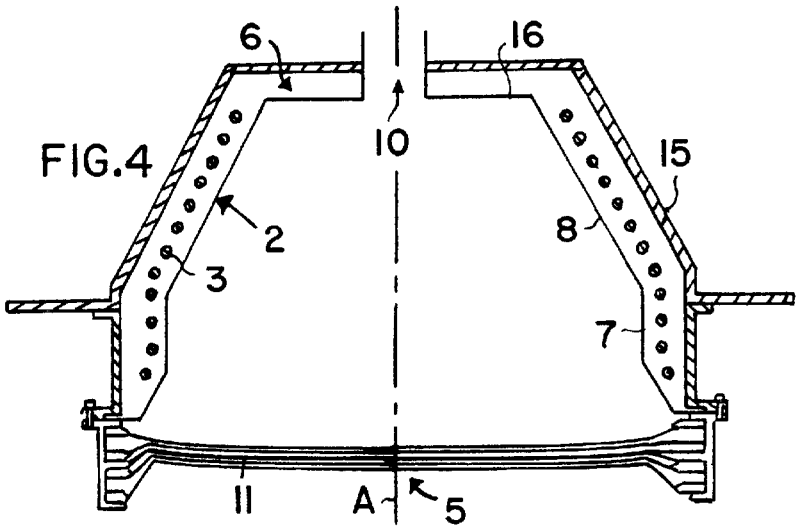
FIG. 4 is a sectional view similar to FIG. 2, but with a further alternative shape of the housing.
Figure 5:
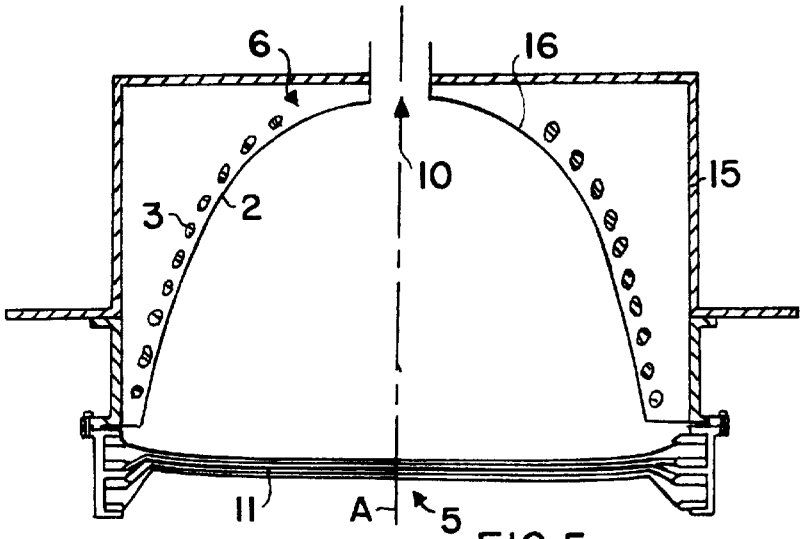
FIG. 5 is a sectional view similar to FIG. 2, but with another alternative shape of the discharge container.

The discharge container 2 is surrounded by a housing 15 whose shape matches that of the discharge container, preferably a cylindrical or conical/cylindrical or conical frustum shape according to the shape of the discharge container 2 (see FIGS. 3, 4 and 5). In the embodiment shown in FIG. 2, the housing 15 is of simple cylindrical shape. The housing 15 serves to provide shielding to the exterior, of the electromagnetic fields generated in the discharge container 2 and to provide heat dissipation to the exterior, by radiation or heat conduction, of the loss heat arising during ionization.

Preferably the housing 15 is designed such that it surrounds the discharge container 2, or the high-frequency coils 3 surrounding said discharge container, at a distance of 1 to 4 cm.

Preferably, the high-frequency ion source is operated so that the high-frequency coil 3 is operated in resonance, both before ignition of the discharge in the discharge container 2 and during idling operation after ignition of the discharge, but without applying an acceleration voltage to the acceleration grid 11, i.e. without generating thrust, as well as during thrust operation with acceleration of the ions through the acceleration grid 11.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What we claimed is:

1. A high-frequency ionic propulsion engine for a spacecraft comprising:

a discharge container forming a discharge chamber therein, wherein said discharge container includes a side wall bounding and enclosing a periphery of said discharge chamber about a central axis of said discharge container, an open end through which said discharge chamber communicates with an exterior environment outside of said discharge container, and an end wall connected to said side wall at a closed end that is located opposite said open end and intersects said central axis, and wherein said side wall of said discharge container includes at least a tapered wall portion that has a tapered shape which tapers without expansion to a reduced dimension about said central axis toward said closed end of said discharge container on a longitudinal section plane along said central axis;

a gas inlet connected to said discharge container communicating into said discharge chamber within said discharge container;

a gas source that is connected to said gas inlet and adapted to supply an ionizable gas through said gas inlet into said discharge chamber;

a high-frequency coil surrounding at least a part of said tapered wall portion of said side wall of said discharge container;

a high-frequency generator connected to said high-frequency coil and adapted together with said coil to generate a high-frequency electromagnetic alternating field that is able to ionize the ionizable gas in said discharge chamber;

an acceleration grid arranged at said open end of said discharge container; and an acceleration voltage source connected to said acceleration grid.

2. The high-frequency ionic propulsion engine according to claim 1, wherein said tapered wall portion of said discharge container has a conical frustum shape about said central axis.

3. The high-frequency ionic propulsion engine according to claim 2, wherein said side wall of said discharge container further comprises a cylindrical wall portion that has a cylindrical shape about said central axis, wherein said cylindrical wall portion is arranged closer to said open end and said tapered wall portion is arranged closer to said closed end.

4. The high-frequency ionic propulsion engine according to claim 2, wherein said tapered wall portion of said discharge container having said conical frustum shape is the entirety of said side wall, so that said side wall has an overall conical frustum shape extending between said open end and said closed end.

5. The high-frequency ionic propulsion engine according to claim 1, wherein said tapered shape of said tapered wall portion of said discharge container is a tapering curved nozzle shape with an increasing curvature as said shape tapers to said reduced dimension.

6. The high-frequency ionic propulsion engine according to claim 1, wherein said end wall at said closed end comprises a planar end surface.

7. The high-frequency ionic propulsion engine according to claim 1, wherein said gas inlet is arranged in said end wall.

8. The high-frequency ionic propulsion engine according to claim 1, wherein said high-frequency coil is a single-layer coil including only a single layer of coil windings about said side wall.

9. The high-frequency ionic propulsion engine according to claim 1, wherein said discharge container comprises an electrically non-conductive material of low loss in a high-frequency range between 0.5 MHz and 100 MHz.

10. The high-frequency ionic propulsion engine according to claim 9, wherein said electrically non-conductive material is at least one of quartz, aluminum oxide, other ceramic material, Vespel, boron nitride or Macor.

11. The high-frequency ionic propulsion engine according to claim 1, further comprising a housing that comprises a conductive material, and that is arranged surrounding said discharge container.

12. The high-frequency ionic propulsion engine according to claim 11, wherein said conductive material is a metal.

13. The high-frequency ionic propulsion engine according to claim 11, wherein said housing has a housing shape that matches an overall shape of said discharge container.

14. The high-frequency ionic propulsion engine according to claim 13, wherein said housing shape comprises a conical/cylindrical shape.

15. The high-frequency ionic propulsion engine according to claim 13, wherein said housing surrounds said discharge container with a spacing distance of 1 to 4 cm therebetween.

16. The high-frequency ionic propulsion engine according to claim 11, wherein said housing has a cylindrical shape.

17. The high-frequency ionic propulsion engine according to claim 1, wherein said high-frequency coil is adapted to be excited by a resonance frequency of 0.5 MHz to 5 MHz.

18. The high-frequency ionic propulsion engine according to claim 1, wherein said high-frequency generator (4) comprises a phase-locked loop (PLL) control circuit.

19. A method of operating the high-frequency ionic propulsion engine according to claim 1, comprising the following steps:

a) before igniting a discharge in said discharge chamber, operating said high-frequency coil in resonance, without applying an acceleration voltage to said acceleration grid;

b) after said step a), igniting a discharge in said discharge chamber, and operating said high-frequency coil in resonance after said igniting of said discharge, without applying an acceleration voltage to said acceleration grid so as to establish an idling operation; and c) after said step b), applying an acceleration voltage to said acceleration grid so as to establish a thrust operation, and operating said high-frequency coil in resonance during said thrust operation.

20. The method according to claim 19, further comprising continuously operating said high-frequency coil in resonance throughout all of said steps a), b) and c).

21. The high-frequency ionic propulsion engine according to claim 1, wherein said end wall at said closed end comprises a curved end surface.

22. The high-frequency ionic propulsion engine according to claim 1, wherein said side wall is a solid side wall so as to bound and enclose said periphery of said discharge chamber.

23. The high-frequency ionic propulsion engine according to claim 1, wherein said gas source is connected by said gas inlet directly to said discharge container so as to supply the ionizable gas directly into said discharge chamber without supplying the ionizable gas outside of said discharge container, and said high-frequency coil is arranged entirely outside of said discharge container and said discharge chamber so as not to be exposed to the ionizable gas.

24. A high-frequency ionic propulsion engine for a spacecraft comprising:

a discharge container forming a discharge chamber therein, wherein said discharge container includes a side wall bounding a periphery of said discharge chamber about a central axis of said discharge container, an open end through which said discharge chamber communicates with an exterior environment outside of said discharge container, and an end wall connected to said side wall at a closed end that is located opposite said open end and intersects said central axis, and wherein said side wall of said discharge container includes at least a tapered wall portion that has a circular rotationally uniform tapered shape which tapers without expansion to a reduced dimension about said central axis toward said closed end of said discharge container on a longitudinal section plane along said central axis;

a gas inlet connected to said end wall and communicating into said discharge chamber within said discharge container;

a gas source that is connected to said gas inlet and adapted to supply an ionizable gas through said gas inlet into said discharge chamber;

a high-frequency coil surrounding at least a part of said tapered wall portion of said side wall of said discharge container;

a high-frequency generator connected to said high-frequency coil and adapted together with said coil to generate a high-frequency electromagnetic alternating field that is able to ionize the ionizable gas in said discharge chamber;

an acceleration grid arranged at said open end of said discharge container;

an acceleration voltage source connected to said acceleration grid; and a metal housing that is arranged surrounding said discharge container.

* * * * *